United States Patent [19]

Whitten

[11] 4,099,027

[45] Jul. 4, 1978

[54] SPEECH SCRAMBLER

[75] Inventor: James R. Whitten, Scotia, N.Y.

[73] Assignee: General Electric Company, Schenectady, N.Y.

[21] Appl. No.: 646,248

[22] Filed: Jan. 2, 1976

[51] Int. Cl.[2] ..... H04K 1/00

[52] U.S. Cl. ..... 179/1.5 S; 179/1 J; 179/1.5 R; 307/293

[58] Field of Search ..... 179/1.5 R, 1.5 S, 15.55 T, 179/1 J, 1 SW; 307/293

[56] References Cited

U.S. PATENT DOCUMENTS

| | | | |
|---|---|---|---|
| 2,987,614 | 6/1961 | Roberts et al. | 179/15.55 T |
| 3,402,355 | 9/1968 | Hannan et al. | 307/293 |
| 3,502,994 | 3/1970 | Ott et al. | 307/293 |
| 3,723,878 | 3/1973 | Miller | 179/1.5 R |
| 3,731,197 | 5/1973 | Clark | 178/22 |
| 3,749,837 | 7/1973 | Doughty | 179/15.55 T |
| 3,773,977 | 11/1973 | Guanella | 179/1.5 R |
| 3,846,827 | 11/1974 | Eppler, Jr. | 179/15.55 T |
| 3,878,472 | 4/1976 | Osakabe | 179/15.55 T |
| 3,920,905 | 11/1975 | Sharp | 179/1 J |
| 3,949,174 | 4/1976 | Sutton | 179/15.55 T |
| 3,959,597 | 5/1976 | Keiser | 179/15.55 T |
| 3,975,763 | 8/1976 | Kitamura | 179/15.55 T |

*Primary Examiner*—Howard A. Birmiel

*Attorney, Agent, or Firm*—Joseph T. Cohen; Jerome C. Squillaro

[57] ABSTRACT

A speech scrambler for rendering unintelligible a communications signal for transmission over nonsecure communications channels includes a time delay modulator and a coding signal generator in a scrambling portion of the system and a similar time delay modulator and a coding generator for generating an inverse signal in the unscrambling portion of the system.

16 Claims, 7 Drawing Figures

SPEECH SCRAMBLER

This invention relates, in general, to speech scramblers, and more specifically, to speech scramblers wherein a speech signal is time modulated by a preselected coding signal to produce a nonintelligible signal suitable for transmission over a nonsecure communication channel and which upon reception is again time modulated, in this instance by a signal which is the inverse of the preselected coding signal, to produce an intelligible output signal corresponding to the signal before scrambling.

It is often times useful to provide for the transmission of a voice or other audio signal over a communications channel in a secure or unintelligible form to prevent useful interception by other than the desired receiving party. A number of techniques, generally referred to as scrambling techniques, have been heretofore employed in order to achieve this useful end. For example, a relatively elementary technique provides speech scrambling by inversion of the audio frequency band. In operation, means would be provided at the transmitting end for mixing the speech signal to be transmitted with a fixed frequency reference signal and utilizing the mixer output equal to the fixed frequency reference signal minus the speech frequency in order to obtain an unintelligible signal for transmission over a nonsecure communications channel. At the receiving end the process would be repeated in an inverse fashion. For example, to reverse the inversion process described, the scrambled signal would be mixed with a fixed frequency signal of frequency corresponding to the frequency utilized during the scrambling process and the mixer output providing the fixed frequency signal minus the scrambled signal would be utilized to produce at the mixer output a signal substantially identical to that which was applied to the scrambler at the transmitting end of the communications circuit. It is a major disadvantage of speech scrambling systems of this type that they are quite readily susceptible to being intercepted and unscrambled by other than the desired receiver. While simple and inexpensive, the system suffers from the further disadvantage that it is substantially unsuited to implementation in a form providing more than a few scrambling codes. In fact, modification of the system to provide additional scrambling codes is limited to changing the frequency of the fixed reference signal with which the voice communication signal if mixed.

A related but slightly more versatile and hence more complicated scrambling system which has been utilized in the prior art divides the voice communications channel into a plurality of subchannels each including a portion of the frequency range of the entire voice communication channel. Each of these narrow frequency bands may be individually inverted and heterodyned with a fixed reference signal or plurality of fixed reference signals and then recombined in a preselected order to provide a scrambled signal of greater complexity and therefore less susceptible to being intercepted and unscrambled by other than the desired receiving station. Further, by merely changing the order of recombination of the several speech sub-bands, a speech scrambler of the type described may provide a number of different and distinct scrambling codes by merely reprogramming rather than restructuring the device.

Digital scramblers have also been utilized in the prior art. A particularly effective, although complex technique employs means for converting an analog speech signal to a digital data stream. This data stream may be transmitted as produced providing a signal which although unintelligible might readily be decoded by an undesired receiver who merely discovers the encoding conversion system. Enhanced security may be obtained, however, by reordering the digital data stream by time division. It will be appreciated that both the number of bit per recorded data segment and the particular method for reordering may be readily varied to produce a signal which achieves a very high degree of complexity and which, therefore, is extremely difficult to render intelligible by an undesired receiver. It is a disadvantage of analog-to-digital speech scrambling techniques that the bandwidth requirement for transmitting the encoded signals is subtantially increased over the unscrambled voice signal due to the inherent nature of the process. The Nyquist sampling requirement dictates that voice signals may be accurately digitized through the use of on the order of 8 data bits per sample and at least 2 samples per highest frequency component in the signal. Typical bandwidth requirements for this type of scrambling are based, therefore, upon a data bit stream rate on the order of 64,000 bits per second and are not compatible with the bandwidth currently allocated to voice communication channels. Further, this technique, although effective is expensive to implement and imposes sufficient hardware requirements to be impractical for use in low power drain or hand held equipment.

As early as 1919 speech scramblers were described in U.S. Pat. No. 1,325,574 to H. W. Nichols employing the modification of the time phase relationship of succeeding portions of a signal wave. Nichols described a system wherein a continuous tape loop was utilized in conjunction with a system of fixed and movable recording heads driven by cam operated devices to provide variable relative motion between the tape and the recording and playback heads. Depending upon the relative velocities of the tape heads and tape loop, both the time phase relationship and time order of the signals placed on the tape might be altered. It appears therefore to be a requirement of a device in accordance with the Nichols patent that the velocity of the movable tape head be maintained below that of the tape itself. The necessity for employing cam driven reciprocating mechanical arms and journals therefor restricts the extent to which variations in coding may be employed. Further, as described by Nichols, such coding signals as are employed are repetitively utilized as the cam rotates.

It is an object of this invention to provide a speech scrambling system overcoming the disadvantages of the prior arts scrambling systems hereinabove described. A speech scrambler in accordance with this invention can provide a high degree of intelligibility along with the capability for implementing a large number of distinct scrambling codes. Further, these advantages are achieved with a circuit substantially simpler than any of the prior art systems achieving comparable security. Still further, a speech scrambler in accordance with this invention may be implemented with a relatively small number of components having greatly reduced power consumption and size over prior art types. This invention, therefore, may be readily adapted to use in portable or other equipment having the requirement of low power consumption and/or small size.

It is another object of this invention to provide a speech scrambler employing a serial delay line so as to completely avoid the problem of re-ordering signals in time.

It is yet another object of this invention to provide a speech scrambling system wherein many scrambling codes may be easily utilized.

It is another object of this invention to provide a speech scrambler which is wholly electronic in nature and which utilizes no mechanical parts.

It is another object of this invention to provide a speech scrambler suitable for being implemented in integrated circuit form.

Briefly stated, and in accordance with one aspect of this invention, a speech scrambler for rendering a voice signal unintelligible for transmission over a communications path including a transmitting terminal and a receiving terminal includes, in conjunction with the transmitting terminal, a time base modulator having an input and an output, the input of which is adapted to be connected to a source of voice frequency signals to be scrambled and the output of which is adapted to be connected to the transmitting terminal. The time modulator also includes a modulating input to which is applied a preselected coding signal of known waveform. A similar time modulator is provided at the receiving terminal. The input to the time modulator is taken from the output of the receiving terminal and is characterized by the scrambled waveform as transmitted. A coding signal which is the inverse of the signal utilized to produce the scrambled signal for transmission by the transmitting terminal is applied to the receiving time modulator, the output of which is substantially identical to the unscrambled voice signal applied to the time modulator at the transmitting terminal.

In accordance with one embodiment of this invention, the time base modulators hereinabove described may be implemented utilizing charge transfer delay lines, as far example, surface charge transfer delay lines or bucket-brigade delay lines in combination with voltage variable clock oscillators, the output frequency of which vary in accordance with a control signal applied thereto. Typically, a clock oscillator is provided having a nominal center frequency about which variations in frequency occur which variations are proportional to the sign and magnitude of an applied waveform. In accordance with one embodiment of this invention, a waveform may usefully be employed which is a series of half sinusoidal cycles the phase of which is determined by a preselected digital data stream of the type which might be generated, for example by a pseudorandom binary sequence generator.

The features of the invention which are believed to be novel are pointed out with particularity in the appended claims. The invention itself, however, both as to its organization and method of operation together with further objects and advantages thereof may best be understood by reference to the following description taken in connection with the accompanying drawings in which:

Figure 1:
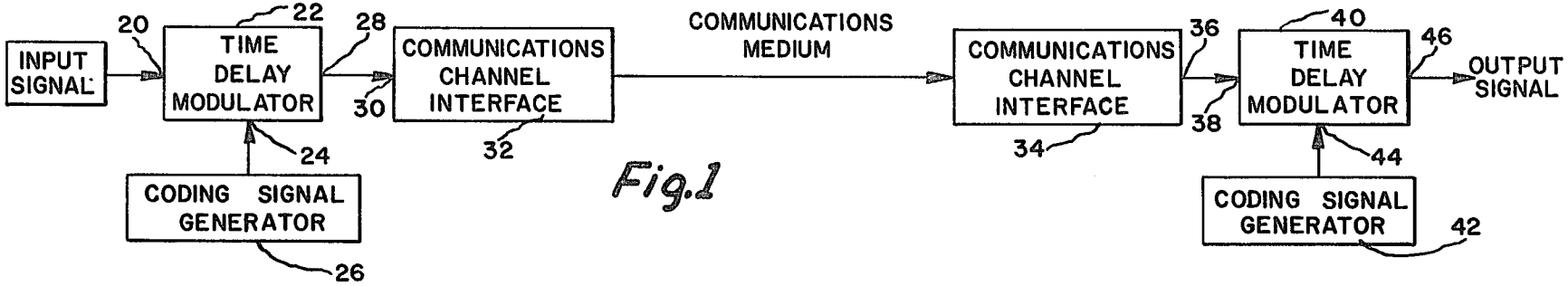
FIG. 1 is a block diagram of scrambling and unscrambling system in accordance with one embodiment of this invention.

A block diagram of a speech scrambler in accordance with this invention is illustrated at FIG. 1. An input signal which may be any signal of the type generally transmitted over communications channels, as for example, but not limited to speech signals, data signals, video signals or any other signal desired to be transmitted by a particular user is applied to input 20 of time delay modulator 22. This invention is particularly useful in scrambling voice signals and will be particularly described in a system utilizing signals of that type. It is to be understood that the input signal applied to input 20 may be of general form as desired without further modification of the invention except as described hereinbelow. Time delay modulator 22 may vary in form and detail without deviating from the true spirit and scope of this invention. An exemplary time delay modulator is described hereinbelow which utilizes charge transfer delay line means and a voltage controlled oscillator circuit to achieve time delay modulation of the input signal applied to input 20. Other forms of time delay modulators are described for example in co-pending United States patent application Ser. No. 646,249 of Whitten for TIME DELAY MODULATOR of common assignee herewith, the contents of which are incorporated herein by reference. Second input 24 of time delay modulator 22 is connected to coding signal generator 26. Output 28 of time delay modulator 22 provides a signal which is a function both of the input signal and the signal applied to second input 24. Where the input signal is represented as a function of time, $f(t)$ and the signal applied to input 24 is represented as $m(t)$, the signal appearing at output 28 of time delay modulator 22 may be represented as $f(t - \tau)$ where $\tau = \tau_0 + K\, m(t)$ where K = the time delay deviation constant of the time delay modulator expressed in units of time deviation per volt or other conventional units. The system is subject to the constraint that $$K \cdot m(t) < \tau_0.$$

Further, it is to be understood that the mean value of $m(t)$ is equal to zero. The limitation that the mean value of $m(t) = 0$ is a limitation for the purpose of facilitating the understanding of this invention rather than a limitation inherent in the invention. It is to be understood that this allows the mean value of $\tau$ to be equal to $\tau_0$.

Output 28 of time delay modulator 22 is connected to input 30 of communications channel interface 32. Communications channel interface 32 may take a variety of forms in accordance with this invention depending upon the particular communications medium over which it is desired to transmit information. For example, communications channel interface 32 may be an interface to a wire circuit, a transmitter for producing radio frequency signals to be transmitted either via a wire or wireless mode, a video transmission interface or a laser transmission interface. This invention is not limited to any particular form of communications medium nor to any particular form of communications channel interface and the exemplary interfaces hereinabove mentioned are not intended to limit the scope of this invention. Although the invention is not limited to any particular communications medium, it is most advantageously employed in conjunction with a medium not inherently secure.

After transmission over the communications medium, the transmitted signal is applied to second communications channel interface 34. Communications channel interface 34 is selected to be compatible both with the communications medium and communications channel interface 32. This is to say that communications channel interfaces 32 and 34 provide a normal communications system, as for example, a transmitter and receiver. Output 36 of communications channel interface 34 is applied to input 38 of second time delay modulator 40. Coding signal generator 42 is connected to second input 44 of time delay modulator 40. Coding signal generator 42 is adapted to provide a signal to input 44 of time delay modulator 40 which is the inverse of the signal provided to input 24 of time delay modulator 22 by coding signal generator 26. Time delay modulator 40 is substantially identical to time delay modulator 22 and produces an output signal at output 46 thereof which duplicates the input signal applied to input 20 of time delay modulator 22. The operation of time delay modulator 40 may be quite readily comprehended by considering the following relationships. The input to time delay modulator 40 may be represented as the output of time delay modulator 22 of viz. $f(t - \tau_1)$. The input applied to input 44 may be represented as $-m(t)$ the output signal appearing at output 46 therefore is $f(t - \tau_1 - \tau_2)$. It will be recalled that $\tau_1 = \tau_0 + K \cdot m(t)$, and it will be seen that $\tau_2 = \tau_0 - K \cdot m(t)$ and therefore that $f(t - \tau_1 - \tau_2) = f(t) - 2\,\tau_0)$. This expression represents the input signal delayed by a fixed time and, in fact, is the exact equivalent of the input signal modified only by a fixed time delay.

Figure 2:
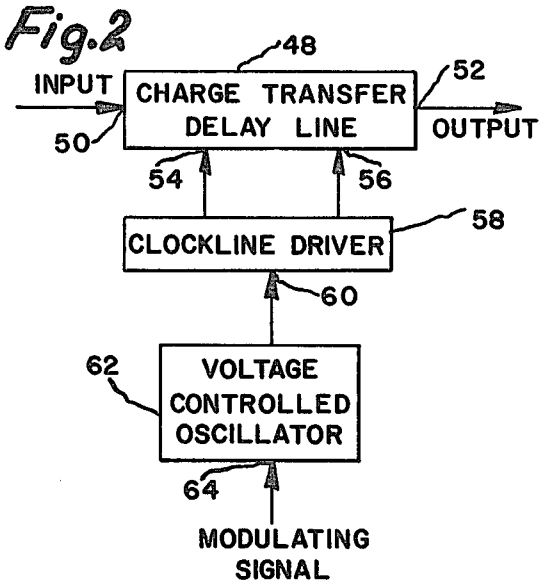
FIG. 2 is a somewhat more detailed block diagram of an exemplary time base modulator of a type suited to be utilized in accordance with this invention. The time base modulator of FIG. 2 may equally well be employed as a scrambler or unscrambler in accordance with this invention depending upon the particular modulating signal applied thereto.

An exemplary time delay modulator in accordance with this invention is illustrated in FIG. 2. A charge transfer delay line 48 includes an input 50 and an output 52 along with two clock inputs 54 and 56. Charge transfer delay lines are well known in the art and it will be appreciated that they take many forms. For example, bucket-brigade delay lines of the type described, in U.S. Pat. No. 3,546,490 to F. L. J. Sangster for MULTI-STAGE DELAY LINE using capacitor charge transfer or surface charge transfer devices of the type described, for example in U.S. Pat. No. 3,795,847 to Engeler et al. for METHOD AND APPARATUS FOR STORING AND TRANSFERRING INFORMATION may readily be employed. Referring again to FIG. 2, clock line driver 58 provides the required control signals for operating charge transfer delay line 48 to terminals 54 and 56 thereof. The precise form of signals applied to inputs 54 and 56 depends upon the type of charge transfer delay line employed. Input 60 of clock line driver 58 is connected to voltage controlled oscillator 62. Voltage control oscillator 62 is provided with input 64 adapted to be connected to a modulating signal. In accordance with this invention, input 64 corresponds to input 24 of time delay modulator 22 in FIG. 1 and would be connected in accordance therewith to coding signal generator 26.

Figure 3:
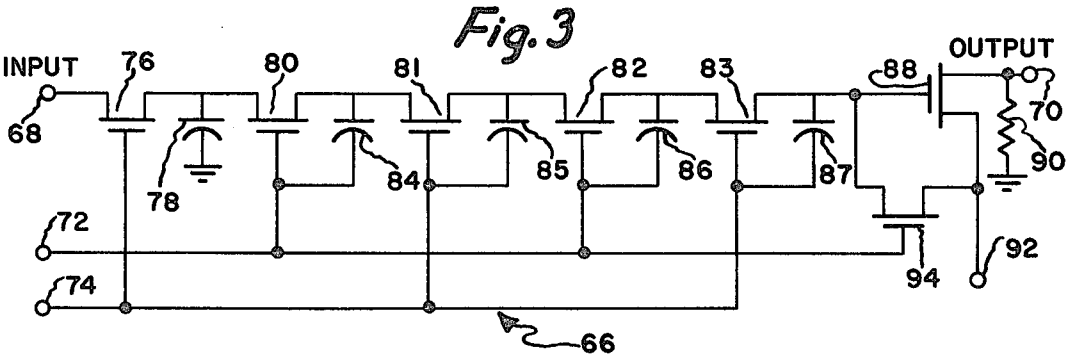
FIG. 3 is a schematic diagram of a bucket-brigade delay line in accordance with this invention.
Figure 4:
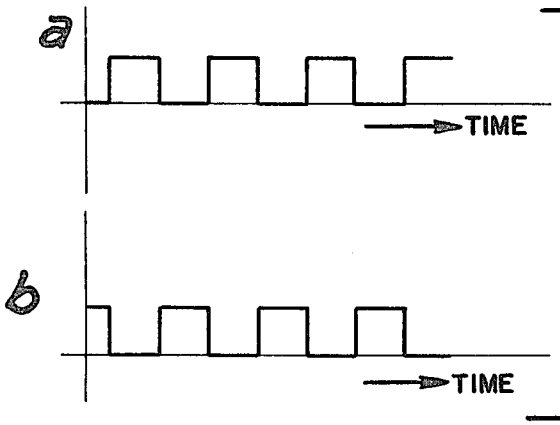
FIG. 4 is a waveform diagram of clock signals which may be utilized in conjunction with the bucket-brigade delay line of FIG. 3.

A conventional bucket-brigade delay line is illustrated at FIG. 3 and clock line driver waveforms appropriate for utilization in conjunction with a delay line of the type illustrated in FIG. 3 are depicted in schematic form in FIG. 4. Bucket-brigade delay line 66 includes an input terminal 68 corresponding to input terminal 50 of charge transfer delay line 48, an output terminal 70 corresponding to output terminal 52 and first and second clock inputs 72 and 74 corresponding to clock inputs 54 and 56 of FIG. 2. The waveforms of FIGS. 4*a* and *b* are applied to clock inputs 72 and 74, respectively. Bucket-brigade delay line 66 includes an input sampling stage consisting of transistor switch 76 and sampling capacitor 78. In the illustrative embodiment of this invention illustrated in FIG. 3, only four charge storage locations including transistors 80, 81, 82 and 83 and capacitors 84, 85, 86 and 87. As is conventional, a single bucket-brigade delay line stage is considered to include two charge storage locations, as for example, in the embodiment of FIG. 3 transistors 80 and 81 and associated capacitors 84 and 85. FIG. 3 illustrates therefore a two stage delay line. It will be appreciated that in accordance with this invention, it may be advantageous to provide a delay line having a significantly greater number of bucket-brigade stages. Output 70 is provided by a transistor amplifier including transistor 88 and resistor 90. Transistor 88 is connected to input terminal 92 which, in turn, is adapted to be connected to a source of precharge voltage. Terminal 92 is further connected through transistor switch 94 to capacitor 87. FIG. 4 illustrates the clock waveforms preferably applied, in accordance with this invention, to clock inputs 72 and 74. It will be appreciated that the waveforms of FIGS. 4*a* and *b* are complements of each other, that is to say when one is in the high logic state, the other is in the low logic state and the reverse is also true.

In operation, the bucket-brigade delay line of FIG. 3 propagates signal samples therethrough at a rate proportional to the frequency of the clock signals applied to clock inputs 72 and 74. In accordance with FIG. 2 where the clock signals are provided by a clock line driver which, in turn, is controlled by a voltage controlled oscillator the instantaneous clock frequency is varied in accordance with the modulating signal and the instantaneous delay through the bucket-brigade delay line of FIG. 3 similarly varies in accordance with the modulating signal.

In addition to the aforementioned United States patent to Sangster reference may advantageously be made to IEEE Transactions on Solid State Circuits, Vol. SC8; No. 2, April 1973 wherein delay lines of the type hereinabove described are extensively discussed.

In operation, the time delay of the bucket brigade delay line of the type illustrated in FIG. 3 or an equivalent charge transfer delay line is given by:

$$TD = N/2f_c \qquad \text{(eq. 1)}$$

where N is the total number of charge storage locations (including, in the case of structures of the type illustrated in FIG. 3, two transistor switches and associated capacitors as hereinabove described) and $f_c$ is the clock frequency. As was hereinabove described, the output frequency of the waveforms illustrated at FIGS. 4 *a* and *b* varies in a linear manner with the modulating signal. The instantaneous radian frequency of the signals applied to clock inputs 54 and 56 may be expressed as:

$$W_i = W_o + \Delta W g(t) \quad \text{(eq. 2)}$$

where $W_i$ is the instantaneous frequency, $W_o$ is the frequency in the absence of modulation, $\Delta W$ is the frequency deviation constant and $g(t)$ is the modulating function. Since phase is the integral of frequency, the phase of the voltage controlled oscillator output may be expressed as $$\theta(t) = W_o t + \theta_o + \Delta W \int_o^t g(t)\, dt \quad \text{(eq. 3)}$$

wherein the $\theta_o$ is the output phase in the absence of modulation. Where the modulation function is a cosine modulating function having, for example, an instantaneous frequency $W_m$, equation 3 may be expressed as $$\theta(t) = W_o t + \theta_o + \frac{\Delta W}{W_m} \sin W_m t \quad \text{(eq. 4)}$$

The output waveform of the voltage controlled oscillator is $$f(t) = \sin\left(W_o t + \theta_o + \frac{\Delta W}{W_m} \sin W_m t\right) \quad \text{(eq. 5)}$$

Bucket-brigade delay line 66 samples the value of the input applied to input 68 thereof at the even zero crossings of $f(t)$. These zero crossings occur at times which will be expressed as $(t - t_n)$ which may be obtained by solving $$W_o t_n = \theta_o + \frac{\Delta W}{W_m} \sin W_m t_n = 2\pi n \quad \text{(eq. 6)}$$

wherein $n$ is a positive integer (0,1,2 etc.). As was hereinabove described each sample is delayed during its propagation through the bucket-brigade delay line by N/2 sampling events during its propagation through N stages of the bucket-brigade delay line. This is due, as will be recalled, to the fact that each effective delay stage includes two actual stages. Output events, that is to say, the occurrence of an output signal at output terminal 70 occur simultaneously with the input events and may therefore be represented as $(t - t_p)$ and may be derived from $$W_o t_p + \theta_o + \frac{\Delta W}{W_m} \sin W_m t_p = 2\pi\left(\frac{N}{2} + n\right) \quad \text{(eq. 7)}$$

The time delay for any particular sample, $n$, is $t_p - t_n$ which may be obtained by simultaneous solution of equation 6 and 7.

Figure 5:
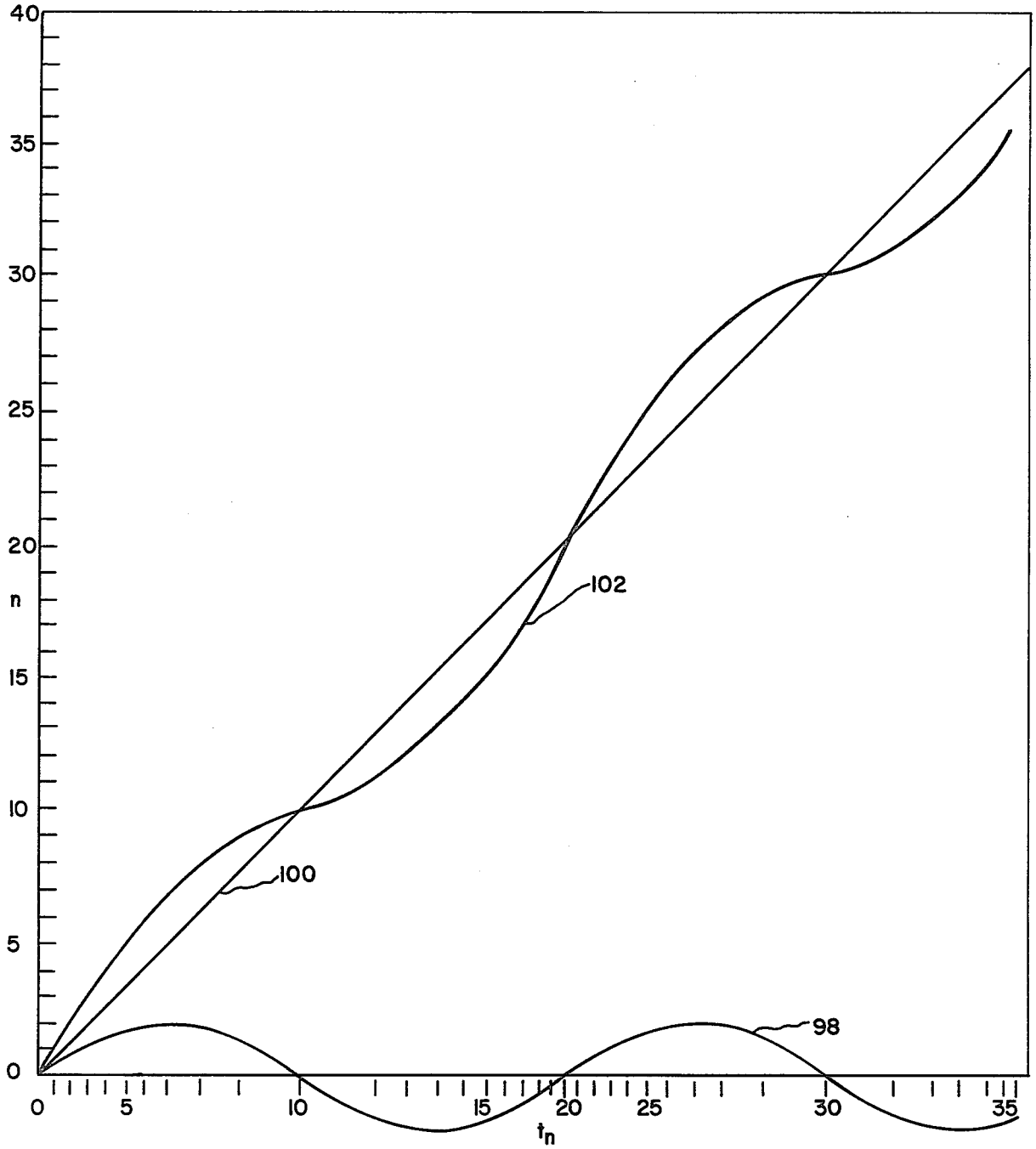
FIG. 5 is a graphical representation of the relationship between particular samples of an input signal and the time delays associated therewith.

FIG. 5 illustrates graphically the relationship between $n$ and $t_n$. Values of $n$ occur along the ordinate and those of $t_n$ along the abscissa. Curve 98 is a sinusoidal modulating function of $$\frac{\Delta W}{W_m} \sin W_m t$$

Curve 100 is $W_o t$ which represents the relationship between $n$ and $t_n$ in the absence of modulation, and curve 102 is the sum of curves 98 and 100:

$$W_o t + \frac{\Delta W}{W_m} \sin W_m t$$

It will be appreciated by reference to FIG. 3 and also to equation 6 that where $\theta_o = o$, $t_n$ may be readily determined by solving $$W_o t_n + \frac{\Delta W}{W_m} \sin W_m t_n = 2\pi n \quad \text{(eq. 8)}$$

where $n$ is a positive integer (0,1,2, etc.). It will be recalled that due to the nature of delay line 66 output samples occur simultaneously with input samples. The output sample representing a particular input sample occurs N/2 sample periods after the input sample. It will be appreciated with reference to FIG. 5 that where the period of the modulating waveform is equal to the unmodulated time delay that the total delay of each input sample will be the same. Referring specifically to FIG. 5, wherein N/2 = 20, it will be seen that for each N, $$t_n + \mathrm{N}/2 - t_n = 20$$

the exact value of the unmodulated time delay. Therefore, each sample undergoes the same time delay and the net time delay modulation is zero. This produces no net scrambling effect and therefore is to be avoided in the design of a speech scrambler in accordance with this invention.

It will be appreciated that the same effect which produces a zero net time delay modulation in a single charge transfer delay line in accordance with this invention as has been hereinabove described may usefully be employed in conjunction with a speech scrambler system to illustrate one method for obtaining scrambling and unscrambling. For example, where a sine wave is employed as a coding signal, when the period of the sine wave is identical with the total unmodulated time delay of the scrambling and unscrambling time delay modulators, the total net time delay will be a constant and the net time delay modulation zero. In an exemplary embodiment of this invention, a 512 stage bucket-brigade delay line is employed as the delay line in both the scrambler and unscrambler portions of the system. The clock line driver (see FIG. 2) operates at a nominal, unmodulated, frequency of 50 Kilohertz. It will be appreciated that the total unmodulated time delay therefore each delay line is one divided by 50,000 or 0.00002 seconds per stage which when multiplied by 256 stages equals 0.00512 seconds. Since the total time delay includes two time delay modulators, the total system time delay due to the time delay modulators is 0.01024 seconds. A coding signal having a period of 0.01024 seconds will produce, therefore, a total net time delay equal to the unmodulated time delay and a net time delay modulation of zero. The frequency which corresponds to a time delay of 0.01024 seconds is 97.65625 Hertz. In a presently preferred embodiment of this invention, a sinusoidal modulating signal having a frequency equal to 97.65625 Hertz is employed as both the coding and decoding signal.

It will be appreciated that harmonics of 97.65625 Hertz may also readily be employed with the exception that even harmonics be avoided for the reasons hereinabove stated, viz. that even harmonics will produce no net scrambling at the output of the scrambling portion of the system although the total time delay modulation will also be zero so that the signal will be intelligible. Therefore, where it is desired that higher scrambling signal frequencies be employed, odd harmonics of 97.65625 Hertz should be utilized in accordance with the exemplary embodiment hereinabove described. For example, signals having relationships of three times, five times, seven times, etc. of 97.65625 Hertz may readily be employed.

As higher frequency coding signals are utilized, it is necessary to provide greater deviation of the clock line driver in order to obtain adequate scrambling. The unintelligibility of a scrambled signal is related to the total time delay modulation measured in seconds. It has been determined that time delay modulation on the order of 1 millisecond provides acceptable scrambling levels to render the output of the speech scrambler substantially unintelligible. In accordance with the exemplary embodiment hereinabove described, the total time delay modulation is related inter alia to the deviation of the clock line driver from the nominal frequency thereof. In a presently preferred embodiment of this invention, a deviation of 15 Kilohertz produces acceptable unintelligibility. As the frequency of the coding signal is increased, greater deviations are required in order to produce the same degree of time delay modulation.

Figure 6:
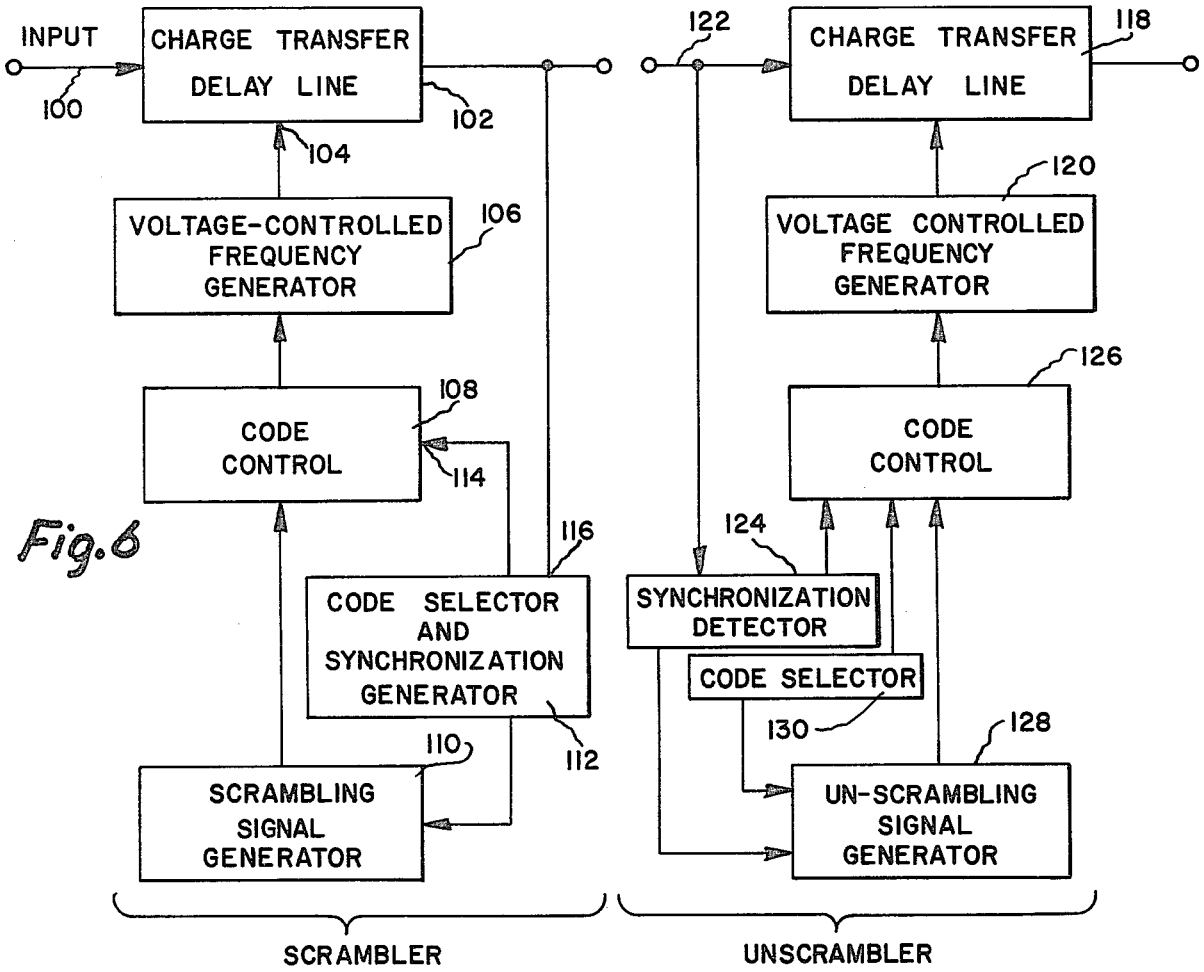
FIG. 6 is a detailed block diagram of a speech scrambler and unscrambler in accordance with this invention.

FIG. 6 is a block diagram of an exemplary scrambler and unscrambler system in accordance with this invention utilizing open loop synchronization. It will be appreciated that a speech scrambler in accordance with this invention and especially of the type illustrated at FIG. 1 requires that the coded signal generators thereof be in synchronization. The system of FIG. 6 illustrates one method for achieving synchronization. FIG. 6 omits to show communications channel interfaces, it being understood that such interfaces will be provided as required depending upon the particular type of communications channel. An input 100 of charge transfer delay line 102 is adapted to be connected to a source of input signals to be scrambled. Charge transfer delay line 102 includes a second input 104 connected to voltage control frequency generator 106. It is to be understood that where charge transfer delay line 102 is a bucket-brigade delay line of the type illustrated at FIG. 3, that voltage controlled frequency generator 106 provides the necessary clock voltages therefore and may, depending upon the particular type of charge transfer delay line, provide more than a single voltage. For example, the voltages applied to input 104 may be of the type illustrated at FIG. 4. Voltage controlled frequency generator 106 is connected to code control module 108 which in turn is connected to scrambling signal generator 110 and also to code selector and synchronization generator 112. In an exemplary embodiment of this invention, scrambling signal generator 110 generates a sinusoidal waveform synchronized to code selector and synchronization generator 112. Code control module 108 provides for the inversion of selected half cycles of the sinusoidal signal provided by generator 110 in accordance with input 114 from code selector and synchronization generator 112. In this way a train of half sinusoidal pulses is provided to voltage controlled frequency generator 106, the phase of each half cycle being determined by code selector 112. It is to be understood that, in accordance with this invention, many methods may be readily employed to produce the signal applied to voltage controlled frequency generator 106. For example, an oscillator might readily be employed at 110 to generate a sinusoidal signal which is selectively rectified by code control module 108 in order to produce a series of half sinusoidal waveforms of selectable phase. Selective rectification might readily be accomplished by controllably selecting either positive or negative rectifiers by code selector and synchronization generator 112. Generator 112 also provides an output port 116 thereof a synchronizing signal which is applied along with the output of delay line 102 to the communications channel. Many means are well known for providing synchronization of signals of the type employed in this exemplary embodiment of the invention, and no particular form is required in accordance herewith. An exemplary synchronization signal might well take the form of a subaudible or superaudible tone continuously transmitted along with the scrambled signal, or accurately timed pulses transmitted during suitable intervals in the scrambled signal either of which method readily provides for the reception and subsequent detection of the synchronizing signals in order to provide the required control for the unscrambling portion of the system of FIG. 6. The unscrambled portion of the system of FIG. 6 includes a second charge transfer delay line 118 which is substantially identical to charge transfer delay line 102. A second voltage control frequency generator 120 corresponding to and substantially identical to voltage control frequency generator 106 is provided. Input 122 of the unscrambler portion of FIG. 6 is adapted to be connected both to charge transfer delay line 118 and to synchronization detector 124. Detector 124 is connected to code control module 126 and to unscrambling signal generator 128. Code selector 130 is connected to code control 126 and to unscrambling signal generator 128. As was hereinabove described in conjunction with the scrambler portion of FIG. 6, synchronization detector 124, code control module 126, unscrambling signal generator 128 and code selector 130 may take a variety of forms depending upon the particular form of scrambling signal desired. Synchronization detector 124 is adapted to be responsive to the type of signal selected to be transmitted by synchronization generator 112 so as to provide precise timing and phase information therefrom. Unscrambling signal generator 128 is selected to provide a signal to code control module 126 identical to the signal provided by the scambling signal generator 110 but inverted therefrom. Code selector 130 is operatively associated with code control module 126 and unscrambling signal generator 128 to provide an input signal to voltage controlled frequency generator 120 which is the inverse of the signal provided to voltage controlled frequency generator 106. For example, when scrambling signal generator 110 is operative to generate a sinusoidal signal and code control module 108 and code selector and synchronization generator 112 provides for the selective phase reversal of half cycles of said sinusoidal signal, unscrambling signal generator 128 is operative to provide a sinusoidal signal 180° separated in phase from the signal present at input 122 that is a result of generator 110, and code selector 130 and code control module 126 provide identical phase reversals to code control module 108 and code selector 112 so that the half sinusoidal signal applied to voltage controlled frequency generator 120 is always 180° reversed in phase from that present at input 122 that is a result of voltage controlled frequency generator 106.

Figure 7:
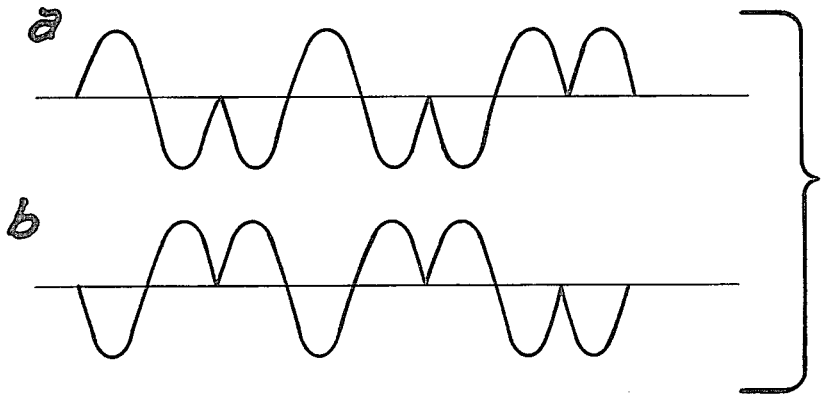
FIG. 7 is a waveform representation of scrambling and unscrambling signals which may be utilized in conjunction with the scrambler of FIG. 6.

The generalized scrambler and unscrambler system of FIG. 6 may readily be adapted to many types of scrambling signals. FIG. 7 illustrates in waveform diagrams *a* and *b* thereof exemplary scrambling waveforms in accordance with this invention. The waveforms of FIG. 7 are phase shifted sinusoidal waveforms as described hereinabove. The sinusoidal waveforms of FIG. 7 have selectable phase in accordance with a particular scrambling code. For example, the waveform of FIG. 7*a* corresponds to a digital code of the form

00111001 wherein a zero bit represents an unshifted sinusoidal waveform and a one bit represents a half cycle of a sinusoidal waveform shifted 180°. FIG. 7*b* is the scrambling signal which would be utilized in the unscrambler portion of an exemplary embodiment of this invention in accordance with FIG. 6. It will be noted that the waveform of FIG. 7*b* is at all times 180° reversed in phase from that in FIG. 7*a*. It is emphasized that in accordance with this invention, the waveforms of FIG. 7 might be varied in order to produce different scrambling signals. For example, the half cycles which, in FIG. 7, are sinusoidal could readily be made triangular, trapezoidal, semicircular or other arbitrary waveforms as desired. It is, of course, desirable in accordance with this invention that whatever method be utilized to generate the scrambling and unscrambling waveforms along with the synchronization signals therefor, that the magnitude and phase of the scrambling and unscrambling signals be matched as closely as possible in order to achieve the most accurate rendition of the input signal at the output of scrambling system.

A speech scrambler in accordance with this invention provides, for the first time, a new and improved speech scrambler readily implemented in a form suitable for inclusion in modern signaling equipments. A speech scrambler of greatly reduced complexity and ease of construction and operation over prior art scramblers of similar effectiveness are provided.

While this invention has been described in accordance with certain preferred embodiments thereof, it will be apparent to one skilled in the art that various modifications and changes in detail might readily be made without departing from the true spirit and scope of the invention. As has been described, various scrambling signals may be employed along with any of a number of synchronization methods to achieve results which are desirable in a particular instance. Further, various particular forms of the elements described herein, for example the delay line, voltage controlled frequency generator, and scrambling signal generator means may be employed by one skilled in the art without departing from the true spirit and scope of this invention as defined in the appended claims.

What is claimed is:

1. A privacy transmission system comprising:

first time delay modulator means including charge transfer delay line means having a signal input adapted to be connected to a source of input signals to be transmitted, a modulation input and an output;

first coding signal generator means connected to said modulation input and providing a first coding signal thereto for nonmonotonically and pseudo-randomly time delay modulating said input signal in accordance with said coding signal and for producing a substantially unintelligible output;

signal transmission means having an input connected to said output of said first time delay modulator means and an output providing a signal suitable for transmission over a communications medium;

signal receiving means for receiving signals from said signal transmission means via said communications medium, said signal receiving means including an output;

second time delay modulator means including charge transfer delay line means having a signal input connected to said output of said signal receiving means, a modulation input and an output; and second coding signal generator means connected to said modulation input of said second time delay modulator means, said second coding signal generator providing a signal to said second time delay modulator which is the inverse of said signal provided by said first coding signal generator;

said output of said second time delay modulator providing a signal thereat substantially similar to said signals provided by said source of input signals.

2. The privacy transmission system of claim 1 wherein said signal transmission means comprises:

radio transmitter means and said signal receiving means comprises radio receiver means.

3. The privacy transmission system of claim 1 wherein said first and second time delay modulator means further comprise:

first and second clock generator means connected with said first and second charge transfer delay means; and first and second voltage controlled oscillator means connected to said first and second clock generator means for modulating the frequency thereof in accordance with said coding signal.

4. A privacy transmission system comprising:

first time delay modulator means including a signal input adapted to be connected to a source of input signals to be transmitted, a modulation input and an output;

first coding signal generator means connected to said modulation input and providing a first coding signal thereto for non-monotonically and pseudo-randomly time delay modulating said input signal in accordance with said coding signal and for producing a substantially unintelligible output, said first coding signal comprising a substantially sinusoidal signal characterized by a period equal to twice the delay time of said first time delay modulator means;

signal transmission means having an input connected to said output of said first time delay modulator means and an output providing a signal suitable for transmission over a communications medium;

signal receiving means for receiving signals from said signal transmission means via said communications medium, said signal receiving means including an output;

second time delay modulator means having a signal input connected to said output of said signal receiving means, a modulation input and an output;

second coding signal generator means connected to said modulation input of said second time delay modulator means, said second coding signal generator providing a signal to said second time delay modulator which is the inverse of said signal provided by said first coding signal generator;

said output of said second time delay modulator providing a signal thereat substantially similar to said signals provided by said source of input signals.

5. The privacy transmission system of claim 4 wherein said first coding signal is further characterized by having selected half cycles thereof reversed in phase with respect to a pure sinusoidal signal according to a preselected coding formula.

6. Speech scrambling apparatus comprising:

electronically variable serial delay line means including a signal input port, a signal output port and a control input port, the time delay of said delay line between said signal input port and said signal output port varying in proportion to a signal applied to said control input port; and means connected to said control input port for generating a preselected waveform so that the time delay of said delay line varies non-monotonically and pseudo-randomly in inverse proportion to the frequency of said preselected waveform.

7. The speech scrambling apparatus of claim 6 wherein said electronically variable serial delay line means comprises:

charge transfer delay line means; and variable clock means having at least one output connected to said charge transfer delay line means for adjustably transferring charge along said charge transfer delay line as determined by the frequency of said preselected waveform.

8. The speech scrambler apparatus of claim 7 wherein the output of said variable clock means is characterized by a waveform having a selected center frequency and which varies from said center frequency by an amount proportional to the magnitude of said control signal.

9. The speech scrambler apparatus of claim 8 wherein said control signal is a sinusoidal signal.

10. The speech scrambler of claim 9 wherein said sinusoidal signal has a period equal to twice the unmodulated time delay of said charge transfer delay line.

11. The speech scrambler apparatus of claim 9 wherein said control signal is characterized by consecutive sinusoidal half cycles the phase of each half cycle being selected according to a preselected pattern.

12. Speech scrambling apparatus comprising:

charge transfer serial delay line means adapted to receive a first electrical speech signal;

a first clock generator means characterized by a first output frequency connected to said charge transfer delay line means for controlling the rate of transfer of speech signals therethrough;

coding generator means for generating a preselected coding signal; and control means connected to said clock generator means for non-monotonically modulating the frequency of said clock generator means in accordance with said coding signal.

13. The speech scrambling apparatus of claim 12 wherein said preselected coding signal is characterized by a period equal to the period of said clock generator means.

14. The speech scrambler of claim 12 wherein said charge transfer delay line means comprises bucket-brigade delay line means.

15. The speech scrambler of claim 12 wherein said control means comprises voltage controlled oscillator means.

16. The speech scrambler of claim 13 wherein said coding signal is characterized by a preselected sequence of half sinusoidal cycles of selected phase.

* * * * *